United States Patent [19]

Karam

[11] 4,006,019

[45] Feb. 1, 1977

[54] METHOD FOR THE PREPARATION OF AN ELECTROSTATOGRAPHIC PHOTORECEPTOR

[75] Inventor: Ronald E. Karam, Webster, N.Y.

[73] Assignee: Xerox Corporation, Stamford, Conn.

[22] Filed: July 3, 1975

[21] Appl. No.: 592,839

Related U.S. Application Data

[63] Continuation-in-part of Ser. No. 513,683, Oct. 10, 1974, abandoned.

[52] U.S. Cl. ..... 96/1.5; 96/1.8; 156/246; 264/235

[51] Int. Cl.[2] ..... G03G 5/04

[58] Field of Search.....96/1.5, 1 R, 1.6–1.8; 156/246; 264/235

[56] References Cited

UNITED STATES PATENTS

| | | | |
|---|---|---|---|
| 2,373,093 | 4/1945 | Baker | 264/235 |
| 3,077,398 | 2/1963 | Jones | 96/1.8 |
| 3,251,686 | 5/1966 | Gundlach | 96/1 R |
| 3,485,624 | 12/1969 | Thiebaut et al. | 96/1.5 |
| 3,546,331 | 12/1970 | Niegisch | 264/235 |
| 3,697,265 | 10/1972 | Teuscher et al. | 96/1.5 |
| 3,787,207 | 1/1974 | Hasegawa et al. | 96/1 R |
| 3,926,762 | 12/1975 | Goldstein | 96/1.5 |

*Primary Examiner*—David Klein
*Assistant Examiner*—Judson R. Hightower
*Attorney, Agent, or Firm*—James J. Ralabate; James P. O'Sullivan; Jerome L. Jeffers

[57] ABSTRACT

Disclosed is an improved process for the preparation of an electrostatographic photoreceptor which comprises:

a. preparing a free-standing film of an unoriented, organic, active transport material by solvent coating the material onto a non-adherent base and removing at least part of the solvent;

b. detaching the film from the base;

c. annealing the film above its glass transition temperature to provide a film free of strains;

d. vapor depositing a film of a photoconductive material onto the organic film; and e. attaching the film of photoconductive material at its exposed surface to a conductive substrate with an adhesive material.

23 Claims, No Drawings

METHOD FOR THE PREPARATION OF AN ELECTROSTATOGRAPHIC PHOTORECEPTOR

BACKGROUND OF THE INVENTION

This is a continuation-in-part application of Ser. No. 513,683, filed Oct. 10, 1974, and now abandoned.

This invention relates to the art of electrostatographic copying and more specifically to a novel method for the preparation of a novel photosensitive device.

In the art of electrostatographic copying, a plate comprising a photoconductive insulating layer is electrostatically charged in the dark in order to apply a uniform charge to its surface. The charged plate is then exposed to activating radiation in imagewise configuration to selectively dissipate the charge in the illuminated areas while leaving behind a latent electrostatic image corresponding to the non-illuminated areas. This latent image is then developed by depositing a finely divided electroscopic marking material on the surface of the plate. This concept, which was originally disclosed by Carlson in U.S. Pat. No. 2,297,691, has been further amplified in many related patents in the field.

Conventional xerographic plates usually comprise a photoconductive insulating layer overlaying a conductive substrate. A photoconductive material which has been widely used as a reusable photoconductor in commercial xerography comprises amorphous selenium.

An improved type of photoreceptor useful in xerographic copying comprises an electrically conductive substrate having on its surface a relatively thin layer of photoconductive material overcoated with a relatively thick layer of an organic active transport material. This type of photoreceptor is advantageous due to its increased flexibility and the protection from physical damage afforded the photoconductor by the layer of active transport material. In addition, this configuration facilitates the use of photoconductors that are too conductive in the dark for use in conventional photoreceptors. The usual method of preparing such a photoreceptor involves applying the layer of photoconductive material to the substrate (such as by the vapor deposition of selenium) and then applying a solution of the organic active transport material to the photoconductive surface. Evaporation of the solvent, which is normally carried out at an elevated temperature, leaves an adherent, continuous layer of the active transport material. This method of fabrication provides a finished photoreceptor which is subject to internal strains and stresses which may cause the active transport layer and/or photoconductive layer to peel away from the rest of the structure. This is the case because the volume of the active transport material is reduced during drying thereby setting up internal strains in the layer. Also, the different coefficients of thermal expansion of the substrate, photoconductor and active transport material lead to additional structural strain at the elevated temperatures normally employed for solvent removal. In addition, thermal shock may further strain the system when the structure is removed from the drying oven. Since the film of organic transport material is constrained on one side due to its being in contact with the photoconductive layer on the substrate, these strains in the organic material are not adequately relieved. The strains thus created often lead to mechanical failure of the photoreceptor.

It would be desirable, and it is an object of the present invention, to provide a novel method for the preparation of an electrostatographic photoreceptor comprising a conductive substrate, a relatively thin layer of a photoconductive material and a relatively thick layer of an organic active transport material overcoating the photoconductive layer.

A further object is to provide such a process in which the photoreceptor prepared is not subject to internal strains resulting in its mechanical failure.

Another object is to provide such a process which can be conveniently carried out in conventional equipment.

SUMMARY OF THE INVENTION

The present invention is an improved method for the preparation of an electrostatographic photoreceptor comprised of a relatively thick layer of an active transport material overcoating a relatively thin layer of a photoconductive material in operative connection with a conductive substrate which comprises:

a. preparing a free-standing film of an unoriented, organic, active transport material by solvent coating the material onto a non-adherent base and removing at least part of the solvent;

b. detaching the film from the base;

c. annealing the film above its glass transition temperature to provide a film free of strains;

d. applying a layer of a photoconductive material to the organic film; and e. attaching the layer of photoconductive material at its exposed surface to a conductive substrate with an adhesive material.

DETAILED DESCRIPTION AND PREFERRED EMBODIMENTS

As used herein, the term active transport material is intended to include an organic material which can be formed into a free-standing film and is capable of supporting the injection of photoexcited holes or transporting electrons from the photoconductive material and allowing the transport of these holes or electrons through the organic layer to selectively dissipate the surface charge. Typical polymeric transport materials include poly(vinylcarbazole), poly(vinylpyrene), poly(vinyltetracene), poly(vinylperylene) and poly(-vinyltetraphene).

The charge transport layer must be sufficiently transparent to allow an amount of radiation to pass through it sufficient to cause the photoconductive layer to function in its capacity as a photogenerator and injector of charge carriers. Preferably, this transparency will be present in the region from about 4000 to 7000 angstrom units.

The thickness of the active transport layer is not critical to the function of the xerographic member. However, the thickness of the layer would be dictated by practical needs in terms of the amounts of electrostatic charge necessary to induce an applied field suitable to effect carrier injection and transport. Active transport layer thicknesses of from about 2 to 100 microns would be suitable and from 5 to 50 microns may preferably be employed. The thickness of the layer of photoconductive material will typically range from 0.05 to 20 microns with a thickness of from 0.03 to 5 microns being preferred.

The first step in preparing a free-standing layer of the charge transport material involves dissolving the material in an appropriate solvent. In general, any organic liquid which will dissolve the material, will not detrimentally react with it and is sufficiently volatile to be evaporated out of the film may be used as solvent. Typical solvents include toluene, cyclohexanone, chloroform, tetrahydrofuran, benzene, dioxane and methylene chloride. Of course, some routine experimentation may be required in order to match the best solvent with the particular charge transport material being used. The material is then solvent coated onto a non-adhering substrate, e.g. Mylar, Kapton, etc., and at least part of the solvent evporated away so as to form a coherent film of the material which can be stripped from the substrate. Selection of the base should be done with the objective of choosing a material which is not softened by the solvent for the active transport material. After removal from the base, the film is heated, optionally under vacuum, to remove additional solvent. Alternatively, the film can be fully dried before its removal from the substrate.

The film is then annealed by heating it to a point at or above its glass transition temperature. As used herein, the term glass transition temperature is used in its general sense as the temperature at which an amorphous material changes from a brittle, vitreous state to a plastic state and the term annealing is meant to refer to the process of heating a material to a specified temperature to remove internal strains and to eliminate distortions and imperfections. The film is normally held at the elevated temperature for a few minutes and cooled gradually during the annealing step.

After cooling, the film of active transport material is coated on one side with a thin layer of the photoconductive material. As used herein, a photoconductive material is a substance which is electrically photoresponsive to light in the wavelength region in which it is to be used. More specifically, it is a material whose electrical conductivity increases significantly in response to the absorption of electromagnetic radiation in a wavelength region in which it is to be used. The photoconductive layer may consist of any suitable inorganic or organic photoconductor which photogenerates hole-electron pairs. Typical inorganic materials include inorganic crystalline compounds and inorganic photoconductive glasses. Exemplary of inorganic materials are cadmium sulfide, cadmium sulfoselenide, cadmium selenide, zinc sulfide, zinc oxide and mixtures thereof. Typical inorganic photoconductive glasses include amorphous selenium and selenium alloys such as selenium-tellurium and selenium-arsenic. Optionally, selenium in the trigonal (crystalline) form may be used as the photoconductive material. This material, which should be applied in a layer from 0.03 to 0.8 $\mu$ in thickness, can be provided by a heat treatment of a previously applied layer of amorphous selenium. This thermal conversion of amorphous selenium to its trigonal (crystalline) form may be readily accomplished by the technique disclosed in copending application Ser. No. 473,859, now U.S. Pat. No. 3,954,464. The technique disclosed in this application involves the application of a thin layer of resinous material over the amorphous selenium to prevent its evaporation during the heating process. Since the instant process will result in the layer of resinous material being between the photoconductor and the substrate, it should be no thicker than about 0.4 micron since the use of a thicker layer will result in the buildup of unacceptably high voltages across the layer during operation of the finished photoreceptor. Proper selection of the resinous material will eliminate the need for a separate blocking layer between the conductive substrate and photoconductive material, since the layer applied to prevent selenium evaporation can serve the additional function of preventing charge injection from the substrate.

During the thermal conversion of amorphous selenium to its trigonal form, some shrinkage will occur in the selenium layer. However, since the great majority of strain will have been eliminated by annealing of the active organic layer, the slight strain caused by the thermal conversion of the selenium layer does not defeat the purpose of the instant invention. Typical organic photoconductors include phthalocyanine pigments such as the X-form of metal free phthalocyanine described in U.S. Pat. No. 3,357,989 and metal phthalocyanine such as copper phthalocyanine. Other typical organic photoinjecting pigments such as bis-benzimidazole pigments, perylene pigments, quinacridone pigments and indigoid pigments may be used. The preceding exemplative summary of photoconductors should in no way be taken as limiting, but is merely illustrative of suitable materials. As will be apparent to those skilled in the art, selection of the best photoconductor to be used in a particular photoreceptor will depend on the active transport material being used.

The photoconductive material is applied to the annealed film of the active transport material in a uniform layer of the desired thickness. Application of the layer is typically accomplished by chemical or physical vapor deposition techniques. Physical techniques include sputtering, ion plating or vapor deposition under vacuum. Chemical techniques involve the vaporization of precursers of the photoconductor so that they impinge upon the substrate and form the photoconductor in situ. Alternatively, a generator layer such as trigonal selenium dispersed in poly(vinylcarbazole) can be solvent coated onto the annealed active transport layer. When this technique is employed, the photoconductive layer will typically be quite thin in relation to the charge transport layer to minimize the chances of introducing internal strains into the system and thereby defeating the purpose of the instant invention. Deposition of the photoconductor onto the annealed film of the active transport material provides a partially finished photoreceptor comprising the film of active transport material with a layer of photoconductive material on its surface.

The two-layered film is next attached to a conductive substrate by use of a thin layer of adhesive material between the substrate and the exposed side of the layer of photoconductive material. The substrate is normally of a conductive material such as brass, aluminum, steel an aluminized polymer, or a conductively coated dielectric or insulator. The substrate may be of any convenient thickness, rigid or flexible and in any desired form such as a sheet, web, belt, plate, cylinder or drum. It may also comprise other materials such as aluminum or glass coated with a thin layer of chromium or tin oxide.

The adhesive material may be either conductive or non-conductive. When the substrate has a blocking layer on its surface or is naturally blocking as in the situation where substantial amounts of energy are required to promote charge carriers from the substrate into the photoreceptor body, a conductive adhesive is normally used. In situations where a distinct blocking layer is required, a non-conductive adhesive can be used and will serve the dual function of holding the substrate to the photoconductor and sustaining an electric field across the photoreceptor after charging by preventing charge injection from the substrate. Typical blocking materials may be employed in thicknesses from about 30 A to 0.4 micron and include nylon, epoxies, aluminum oxide (as in the case of an aluminum substrate whose surface has oxidized) and insulating resins of various types including polystyrene, butadiene polymers and copolymers, acrylic and methacrylic polymers, vinyl resins, alkyd resins and cellulose base resins. As previously mentioned, those insulating resins which have adhesive properties can serve dual functions but must be applied in sufficiently thin layers to provide an operable photoreceptor. When a conductive adhesive, such as a resin filled with metal particles, is used, a thicker layer may be employed. Preferred adhesives are conductive or non-conductive epoxies since they normally do not tend to change volume during curing as is the case with some adhesives which would, accordingly, be less preferred.

The method by which the process of the instant invention is carried out is further illustrated by the following example:

EXAMPLE I

An electrostatographic photoreceptor of the type previously described is prepared as follows:

A thin ($\sim 25\ \mu$) layer of poly(vinylcarbazole) is cast onto a Mylar substrate from its 9% solution in chloroform. The layer separates from the Mylar as the film dries to provide a free-standing film of poly(vinylcarbazole). The film is placed between two sheets of aluminum and dried under vacuum ($\sim 10^{-2}$ Torr) for 4 hours at 125° C. after which it is heated to 245° C. for 8 minutes. The purpose of heating at 125° is to dry the film of solvent and the purpose of heating to 245° is to raise it to a point above its glass transition temperature to thereby anneal it and remove internal strains.

After cooling, the poly(vinylcarbazole) film is placed into a vacuum coater whereupon a layer of amorphous selenium approximately 3500 A thick is vapor deposited thereon while the film is maintained at a temperature of 40° C. The resulting selenium/poly(vinylcarbazole) film is then attached to a strip of aluminized Mylar by use of a layer of epo-tek H20 conductive epoxy manufactured by Epoxy Technology Inc., of Watertown, Mass.

The photoreceptor prepared in this manner, which comprises a four-layer structure of annealed poly(vinylcarbazole)/amorphous selenium/epo-tek H20/aluminized Mylar, is tested for xerographic properties by charging it to an initial field of 39.6 volts/$\mu$. The discharge characteristics are determined by measuring the drop in voltage as a function of time on a chart recorder. It is observed that upon exposure to electromagnetic radiation of 4000 A wavelength and intensity of $8 \times 10^{12}$ photon/cm$^2$-sec. the discharge speed is 90 volts/sec-$\mu$ and the dark discharge rate is 0.2 volts/sec-$\mu$. The residual field (1 second after initial exposure to light) is 23.6 volts/$\mu$.

The above experiment establishes the feasibility of preparing an operative photoreceptor of the type previously described by the process of the instant invention. After testing, the photoreceptor is stored for 8 months with no apparent failure in terms of physical breakup being observed.

What is claimed is:

1. An improved method for the preparation of an electrostatographic photoreceptor comprised of a layer of a polymeric active transport material which is capable of supporting the injection of photoexcited holes or transporting electrons from a photoconductive material and allowing the transport of such holes or electrons through the layer to selectively dissipate a surface charge thereon, said layer being from about 2 to 100 microns in thickness overcoating a layer of a photoconductive material 0.05 to 20 microns thick in operative connection with a conductive substrate which method consists essentially of:

a. preparing a free-standing film of an unoriented, organic, active transport material by solvent coating the material onto a non-adherent base and removing at least part of the solvent;
b. detaching the film from the base;
c. annealing the film above its glass transition temperature to provide a film free of strains;
d. applying a layer of a photoconductive material to the organic film; and
e. attaching the layer of photoconductive material at its exposed surface to a conductive substrate with an adhesive material.

2. The method of claim 1 wherein the active transport material is a hole transport material.

3. The method of claim 2 wherein the hole transport material is poly(vinylcarbazole), poly(vinylpyrene), poly(vinyltetracene), poly(vinylperylene) and poly (vinyltetraphene).

4. The method of claim 1 wherein the layer of photoconductive material is solvent coated onto the film of organic, active transport material.

5. The method of claim 1 wherein the conductive substrate is a polymeric support coated with a layer of aluminum.

6. The method of claim 1 wherein the active transport layer is from about 5 to 50 microns thick.

7. The method of claim 6 wherein the layer of photoconductive material is from 0.03 to 5 microns thick.

8. The method of claim 1 wherein the non-adherent base is a polyester film.

9. The method of claim 1 wherein the photoconductive material is inorganic.

10. The method of claim 9 wherein the inorganic photoconductive material is cadmium sulfide, cadmium sulfoselenide, cadmium selenide, zinc sulfide, zinc oxide or a mixture thereof.

11. The method of claim 9 wherein the inorganic photoconductive material is a photoconductive glass.

12. The method of claim 11 wherein the photoconductive glass is amorphous selenium, or a selenium alloy.

13. The method of claim 12 wherein the selenium alloy is selenium-tellurium or selenium-arsenic.

14. The method of claim 9 wherein the inorganic photoconductor is trigonal selenium.

15. The method of claim 1 wherein the photoconductive material is organic.

16. The method of claim 15 wherein the organic photoconductive material is a phthalocyanine pigment, a bis-benzimidazole pigment, a perylene pigment, a quinacridone pigment or an indigoid pigment.

17. The method of claim 15 wherein the organic photoconductive pigment is the X-form of metal free phthalocyanine.

18. The method of claim 1 wherein the adhesive material is an epoxy.

19. The method of claim 18 wherein the epoxy adhesive is electrically conductive.

20. The method of claim 1 wherein the film of active transport material is dried at an elevated temperature under vacuum before annealing.

21. The method of claim 1 wherein the active transport material is poly(vinylcarbazole) and the photoconductive material is selenium.

22. The method of claim 21 wherein the conductive substrate is aluminum.

23. The method of claim 21 wherein the conductive substrate is a polymeric support coated with a layer of aluminum.

* * * * *